US010801312B2

(12) United States Patent
Hu et al.

(10) Patent No.: US 10,801,312 B2
(45) Date of Patent: Oct. 13, 2020

(54) EXPERIMENTAL APPARATUS AND METHOD FOR SIMULATING TRANSPORT OF SAND-CARRYING FLUID IN FRACTURING FRACTURES

(71) Applicant: SOUTHWEST PETROLEUM UNIVERSITY, Chengdu, Sichuan (CN)

(72) Inventors: Yongquan Hu, Chengdu (CN); Chaoneng Zhao, Chengdu (CN); Jinzhou Zhao, Chengdu (CN); Feng Hui, Chengdu (CN); Qiang Wang, Chengdu (CN); Jin Zhao, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 16/746,926

(22) Filed: Jan. 19, 2020

(65) Prior Publication Data

US 2020/0240252 A1 Jul. 30, 2020

(30) Foreign Application Priority Data

Jan. 24, 2019 (CN) ..... 2019 1 0066001

(51) Int. Cl.
*E21B 43/267* (2006.01)
*E21B 41/00* (2006.01)
*E21B 21/08* (2006.01)

(52) U.S. Cl.
CPC ..... *E21B 43/267* (2013.01); *E21B 41/0092* (2013.01); *E21B 21/08* (2013.01)

(58) Field of Classification Search
CPC ..... E21B 43/267; E21B 41/0092; E21B 21/08
See application file for complete search history.

(56) References Cited

U.S. PATENT DOCUMENTS

2003/0008781 A1* 1/2003 Gupta ..... C09K 8/62 507/240
2013/0233542 A1* 9/2013 Shampine ..... E21B 43/267 166/279

FOREIGN PATENT DOCUMENTS

CN 101968348 A 2/2011
CN 104594871 A 5/2015
(Continued)

OTHER PUBLICATIONS

First Office Action in Chinese Application No. 201910066001.9 dated Jul. 12, 2019, 10 pages.

*Primary Examiner* — Silvana C Runyan

(57) ABSTRACT

The present disclosure discloses an experimental apparatus and method for simulating transport of a sand-carrying fluid in a fracturing fracture. The apparatus may include a spiral proppant transport device, a stirred tank, a screw pump, a liquid transport pump, a pressure gauge, a proppant transport and distribution system, a cyclone desander, a waste liquid recycle container, a proppant recycle container, and a fracturing fluid tank. The spiral proppant transport device may be communicated with the stirred tank. The waste liquid recycle container and the fracturing fluid tank may be communicated with the stirred tank via the liquid transport pump. A bottom end of the stirred tank may be communicated with the proppant transport and distribution system through the screw pump. It is possible to simulate the sand-carrying fluid paved under a closure pressure by setting a computer to precisely control a transparent cuboid fracture member including hydraulic tanks.

7 Claims, 10 Drawing Sheets

(56) References Cited

FOREIGN PATENT DOCUMENTS

| | | | |
|---|---|---|---|
| CN | 204419150 | U | 6/2015 |
| CN | 106153833 | A | 11/2016 |
| CN | 106437668 | A | 2/2017 |
| CN | 206957685 | U | 2/2018 |
| CN | 207296988 | U | 5/2018 |

* cited by examiner

EXPERIMENTAL APPARATUS AND METHOD FOR SIMULATING TRANSPORT OF SAND-CARRYING FLUID IN FRACTURING FRACTURES

CROSS REFERENCE

This application claims priority of Chinese Patent Application No. 201910066001.9 filed on Jan. 24, 2019, the entire contents of which are hereby incorporated by reference.

TECHNICAL FIELD

The present disclosure relates to the technical field of hydraulic fracturing, and in particular relates to an experimental apparatus and experimental method for simulating transport of a sand-carrying fluid in one or more fracturing fractures.

BACKGROUND

In a hydraulic fracturing process, in addition to slickwater, a large amount of proppants needs to be injected to support one or more cracked fractures. Therefore, it is of great significance to investigate a condition of a sand-carrying fluid paved in the fracturing fractures close to the reality.

However, several problems are present in the existing simulation experiments. (1) Widths of a hydraulic fracture and a natural fracture have been set manually before a simulation experiment, and the width change of a proppant during the pave process is not emphasized. (2) In the existing apparatus, two glass plates to simulate the fractures are fixed without considering the closure pressure of the fractures when an artificial fracture and a natural fracture are fractured. Therefore, during the experiment, the fractures are kept open and it is impossible to simulate the proppant paving condition during the process of opening and expansion of the hydraulic fracture and the natural fracture. (3) The proppant may deposit during the transport and paving process. When the slickwater is used to carry sand, the deposit speed of the proppant is relatively fast, resulting in that a width of a lower part of a fracture is larger than that of an upper part of the fracture, which is not solved by the existing apparatus. Thus, there is still a large difference between the simulated transport of the sand-carrying fluid in one or more fractures using the existing simulation experiments and the actual transport of sand-carrying fluid in one or more fractures.

SUMMARY

According to some embodiments of the present disclosure, the shortcomings in the prior art are mainly overcame, and an experimental apparatus and an experimental method for simulating transport of a sand-carrying fluid in one or more fracturing fractures are disposed. The simulated transport of the sand-carrying fluid can be close to the reality. Different closure pressures may be set for one or more hydraulic fractures and one or more natural fractures. The changes, caused by the fracture opening process and the proppant sedimentation, of the fracture widths along a fracture length and a fracture height may be considered, and the fracture width is accurately measured to obtain the transport rule of the sand-carrying fluid in fracturing fractures considering the closing pressures and fracture opening.

According to an aspect of the present disclosure, an experimental device for simulating transport of a sand-carrying fluid in one or more fracturing fractures is disposed. The experimental device may include a spiral proppant transport device, an stirred tank, a screw pump, a liquid transport pump, a pressure gauge, a proppant transport and distribution system, a cyclone desander, a waste liquid recycle container, a proppant recycle container, and a fracturing fluid tank.

The spiral proppant transport device may be communicated with the stirred tank, and the waste liquid recycle container and the fracturing fluid tank may be both communicated with the stirred tank through a liquid transport pump, and a bottom end of the stirred tank may be communicated with the proppant transport and distribution system through the screw pump.

The proppant transport and distribution system may be communicated with the cyclone desander, an upper end of the cyclone desander may be communicated with the waste liquid recycle container, and a bottom end of the cyclone desander may be communicated with the proppant recycle container.

A flowmeter may be disposed between the cyclone desander and the proppant transport and distribution system, and the pressure gauge and the flowmeter are disposed in parallel at two ends of the proppant transport and distribution system.

The proppant transport and distribution system may include a plurality of a transparent cuboid fracture member blocks, an upper cover plate, and a lower cover plate connected to upper ends and lower ends of the transparent cuboid fracture member blocks, respectively, a hydraulic tank filled with a transparent hydraulic fluid may be disposed in each of the plurality of transparent cuboid fracture member blocks, a main fracture inlet may be disposed at a left end of at least one transparent cuboid fracture member block (903) at a leftmost end, a main fracture outlet may be disposed at a right end of at least one transparent cuboid fracture member block at a rightmost end, and one or more natural fracture outlets (906) may be disposed at an upper end of at least one of the plurality of transparent cuboid fracture member blocks (903).

In a further technical solution, a hydraulic control device may be disposed on the proppant transport and distribution system.

In a further technical solution, rubbers may be disposed at the main fracture inlet, the main fracture outlet, and natural fracture outlet, respectively, and three holes may be disposed on each of the rubbers.

In a further technical solution, the flowmeter may be an electromagnetic flowmeter.

In a further technical solution, a stirring shaft driven by a stirring motor may be disposed in the stirred tank, and a plurality of agitation blades may be disposed on the agitation shaft.

In a further technical solution, a weight tester may be disposed below the stirred tank.

An experimental method for simulating transport of a sand-carrying fluid in fracturing fractures may include:

(1) preparing an amount of a proppant and a fracturing fluid according to a needed sand ratio of an experiment, the proppant and the fracturing fluid being transported to the stirred tank (2) through a spiral proppant transport device (1), and being agitated by the stirring motor (4), such that a sand-carrying fluid can be fully mixed;

(2) configuring a transparent cuboid fracture member by assembling a plurality of transparent cuboid fracture member blocks according to a main fracture length required for the experiment, the arrangement of natural fractures, and an interval between the natural fractures, an upper cover plate and a lower cover plate being fixed to an upper surface and a lower surface of the transparent cuboid fracture member through bolts, respectively;

(3) simulating a closure pressure of each of the fractures for the experiment by a hydraulic control device to control the hydraulic tank;

(4) turning on a drive control panel and starting the screw pump;

(5) opening valves at a hydraulic fracture outlet and a natural fracture outlet, and a valve of a cyclone desander;

(6) observing and recording, by a high-definition camera, a process of gradual deformation of the transparent cuboid fracture member, that is, a hydraulic fracture and natural fractures open and gradually expand to a shape of a sand-bank; and (7) determining fracture openings at different locations of the hydraulic fracture and natural fractures by a fracture width measuring device, processing the fracture openings by a computer, and obtaining a rule of the sand-carrying fluid paved in the fractures close to the reality.

The present disclosure has the advantages described below.

1. By setting a computer to precisely control the transparent cuboid fracture member including hydraulic tanks, it is possible to realize the simulation of a sand-carrying fluid paved under a closing pressure. In addition, the transparent cuboid fracture member may generate slight deformation with the change of an injection pressure, so as to study a rule of the sand-carrying fluid paved during the opening and expansion stages of one or more hydraulic fractures and natural fractures.

2. A simulation experiment of the sand-carrying fluid paved in natural fractures, different natural fracture arrangements, and an interval between the natural fractures may be conducted by setting different shapes of hydraulic tanks included in the transparent cuboid fracture member.

3. The flow of each natural fracture can be monitored in real time by installing electromagnetic flowmeters and pressure gages at a hydraulic fracture inlet, a hydraulic fracture outlet, and one or more natural fracture outlets, respectively, and the flow of each natural fracture may be compared at different times.

4. The distribution of fracture widths of a hydraulic fracture and natural fractures in a direction of a fracture height and a direction of a fracture length may be obtained by considering the sedimentation of proppants in the fractures.

5. An experiment conducted by using the apparatus and method of the present disclosure is simple to operate, with large-scale and visual characteristics, the experiment process can be directly observed with the naked eye, the experimental phenomena and rule can be analyzed, a basis may be provided for the optimization of fracturing engineering parameters. The proppant transport and distribution system may be made simply and promoted easily.

Figure 1:
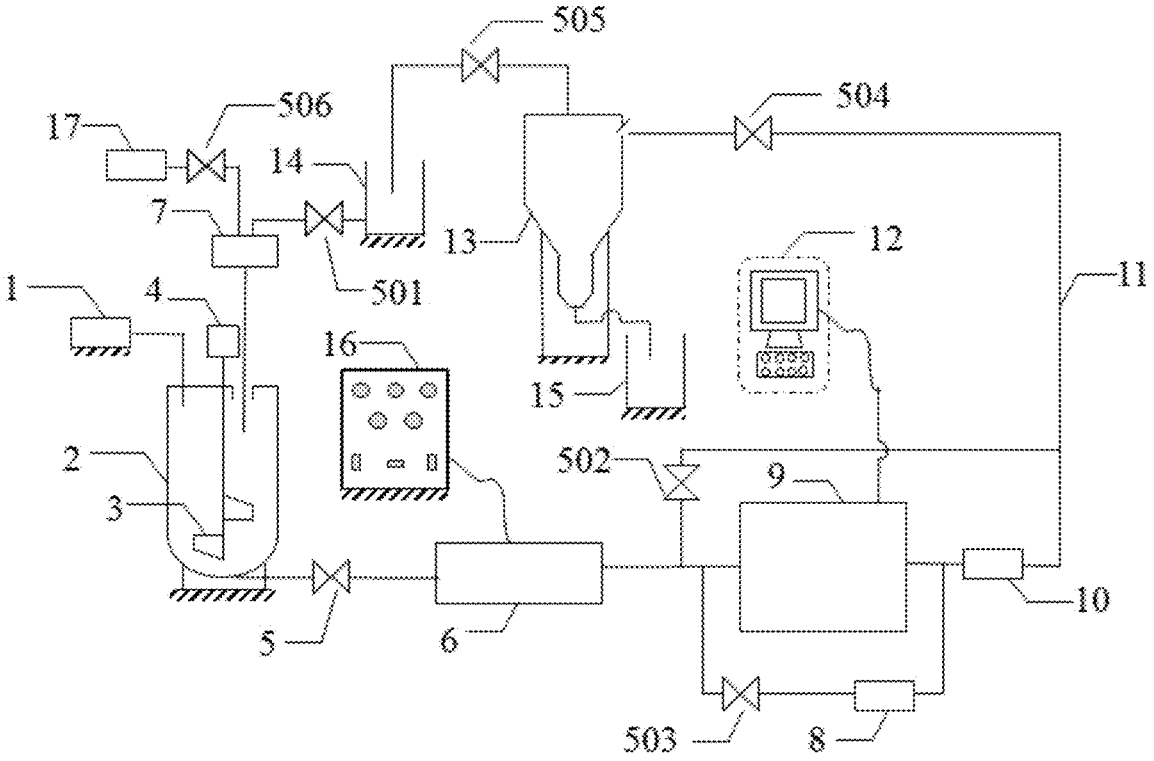
FIG. 1 is a schematic diagram illustrating an exemplary experimental apparatus according to some embodiments of the present disclosure.

As illustrated in drawings: 1 refers to a spiral proppant transport device, 2 refers to an stirred tank, 3 refers to stirring blades, 4 refers to an stirring motor, 5, 501 to 505 refers to valves, 6 refers to a screw pump, 7 refers to a liquid transport pump, 8 refers to a pressure gauge, 9 refers to a proppant transport and distribution system, 10 refers to a flowmeter, 11 refers to a manifold, 12 refers to a hydraulic control device, 13 refers to a cyclone desander, 14 refers to a waste liquid recycle container, 15 refers to a proppant recycle container, 16 refers to a screw pump control panel, 17 refers to a fracturing fluid tank, 901 refers to hydraulic tank, 902 refers to bolts, 903 refers to transparent cuboid fracture member blocks, 904 refers to a main fracture inlet, 905 refers to a main fracture outlet, 906 refers to natural fracture outlets, 907 refers to an upper cover plate, 908 refers to a lower cover plate, 909 refers to a rubber, and 910 refers to holes.

DETAILED DESCRIPTION

The present disclosure is further described below in detail with reference to some embodiments and the drawings.

As shown in FIGS. 1 to 9, an experimental apparatus for simulating transport of a sand-carrying fluid in one or more fracturing fractures according to some embodiments of the present disclosure may include a spiral proppant transport device 1, a stirred tank 2, a screw pump 6, a liquid transport pump 7, a pressure gauge 8, a proppant transport and distribution system 9, a cyclone desander 13, a waste liquid recycle container 14, a proppant recycle container 15, and a fracturing fluid tank 17. These devices may be connected through a manifold 11.

The spiral proppant transport device 1 may be communicated with the stirred tank 2. The waste liquid recycle container 14 and the fracturing fluid tank 17 both may be communicated with the stirred tank 2 via the liquid transport pump 7. A bottom end of the stirred tank 2 may be communicated with the proppant transport and distribution system 9 via the screw pump 6. A stirring shaft driven by a stirring motor 4 may be disposed in the stirred tank 2. A plurality of stirring blades 3 may be disposed on the agitation shaft. A weight tester may be disposed below the agitation tank 2.

The proppant transport and distribution system 9 may be communicated with the cyclone desander 13. An upper end of the cyclone desander 13 may be communicated with the waste liquid recycle container 14. A bottom end of the cyclone desander 13 may be communicated with the proppant recycle container 15.

A flowmeter 10 may be disposed between the cyclone desander 13 and the proppant transport and distribution system 9. The flowmeter 10 may include an electromagnetic flowmeter. The pressure gauge 8 and the flowmeter 10 may be disposed in parallel at two ends of the proppant transport and distribution system 9, respectively.

The proppant transport and distribution system 9 may include a plurality of transparent cuboid fracture member blocks 903, an upper cover plate 907, and a lower cover plate 908 that are fixed to upper ends and lower ends of the transparent cuboid fracture member blocks 903 by bolts 902, respectively. A hydraulic tank 901 filled with a hydraulic fluid may be disposed in each of the transparent cuboid fracture member blocks 903. The hydraulic tank 901 may have different shapes depending on locations of the cuboid fracture member blocks. the proppant transport and distribution system 9 includes a hydraulic control device 12 for controlling a hydraulic pressure in the hydraulic tank 901. A main fracture inlet 904 may be disposed at a left end of at least one of the transparent cuboid fracture member blocks 903 at a leftmost end. A main fracture outlet 905 may be disposed at a right end of at least one of the transparent cuboid fracture member blocks 903 at a rightmost end. Natural fracture outlets 906 may be disposed at upper ends of part of the transparent cuboid fracture member blocks 903. A rubber 909 may be disposed at each of the main fracture inlet 904, the main fracture outlet 905, and the natural fracture outlets 906, and there are three holes 910 on the rubber 909.

Figure 2:
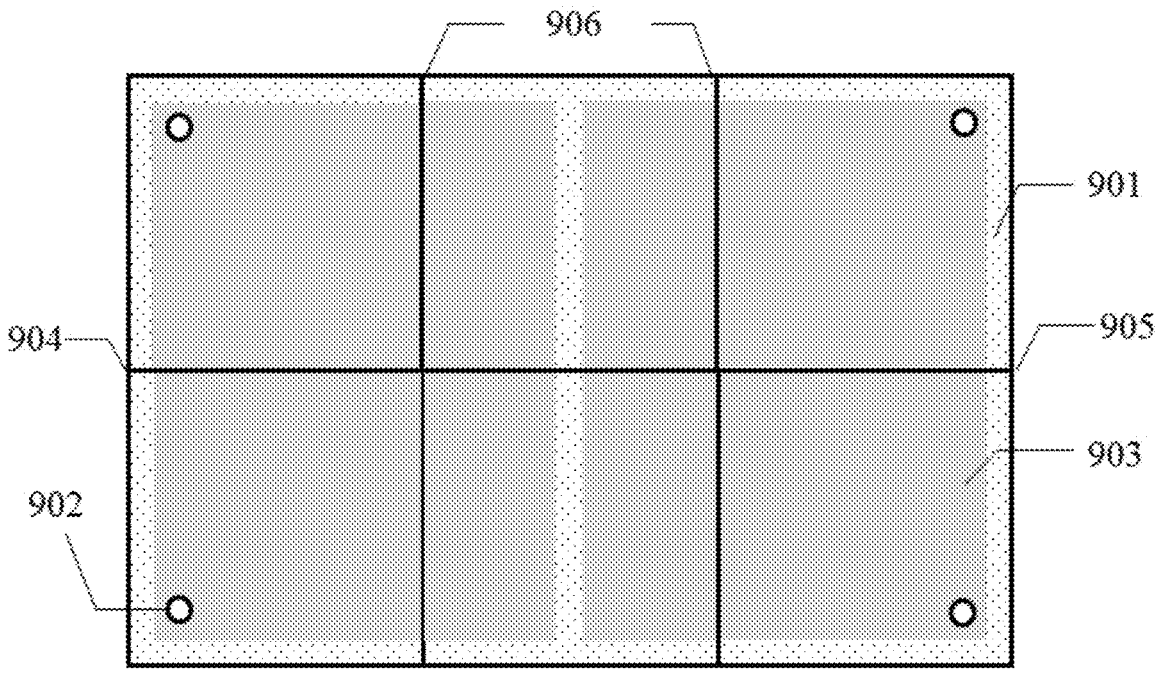
FIG. 2 is a top view illustrating an initial state of an exemplary proppant transport and distribution system under a closure pressure according to some embodiments of the present disclosure.
Figure 3:
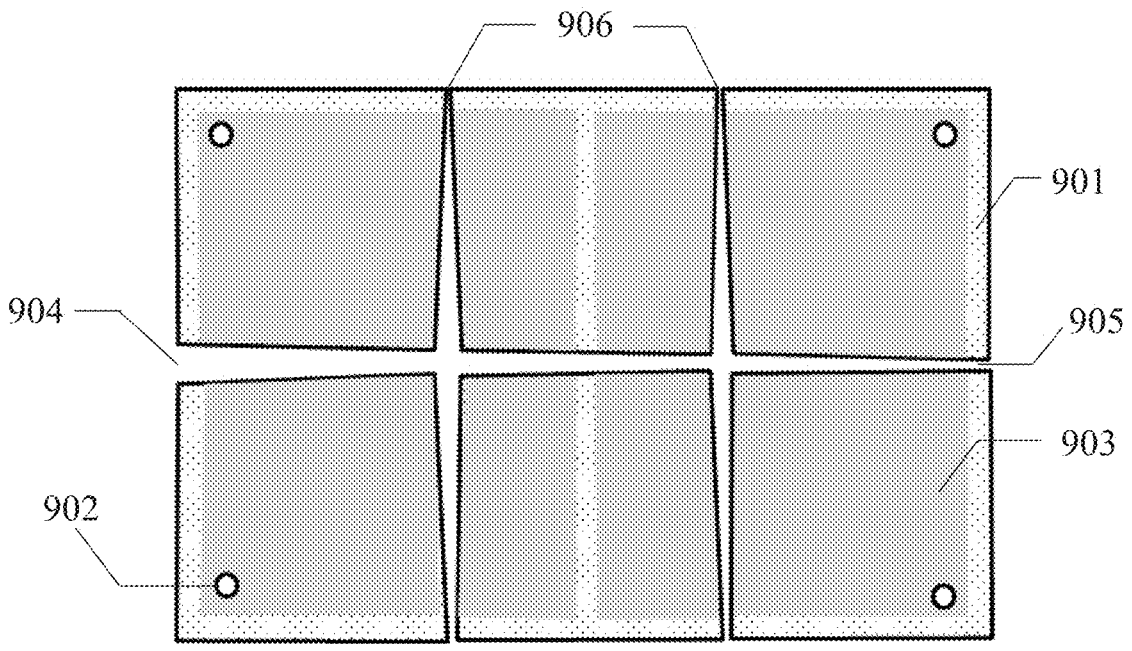
FIG. 3 is a top view illustrating exemplary deformation of a transparent cuboid fracture member in the proppant transport and distribution system due to the pumping of a sand-carrying fluid according to some embodiments of the present disclosure.
Figure 4:
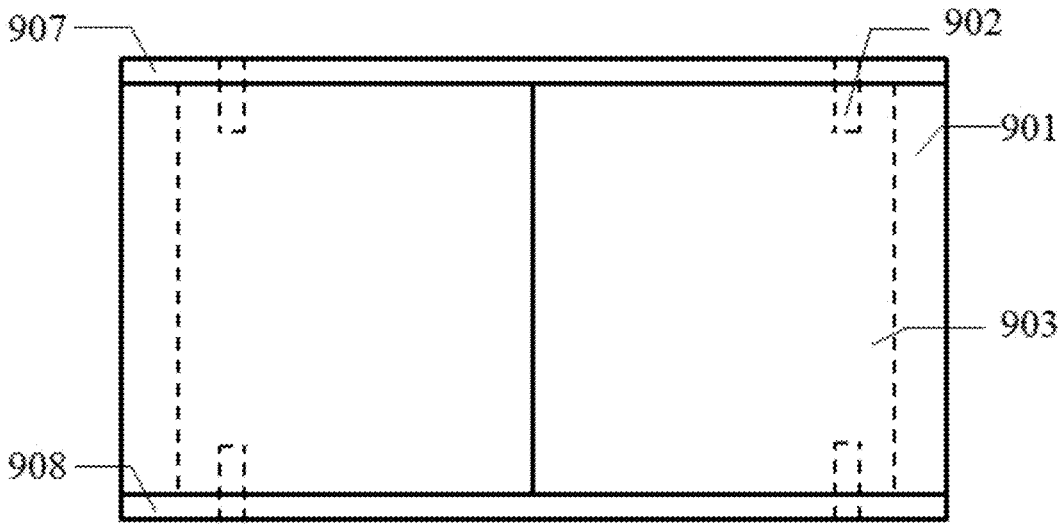
FIG. 4 is a side view illustrating the exemplary proppant transport and distribution system at a main fracture inlet or a main fracture outlet according to some embodiments of the present disclosure.
Figure 5:
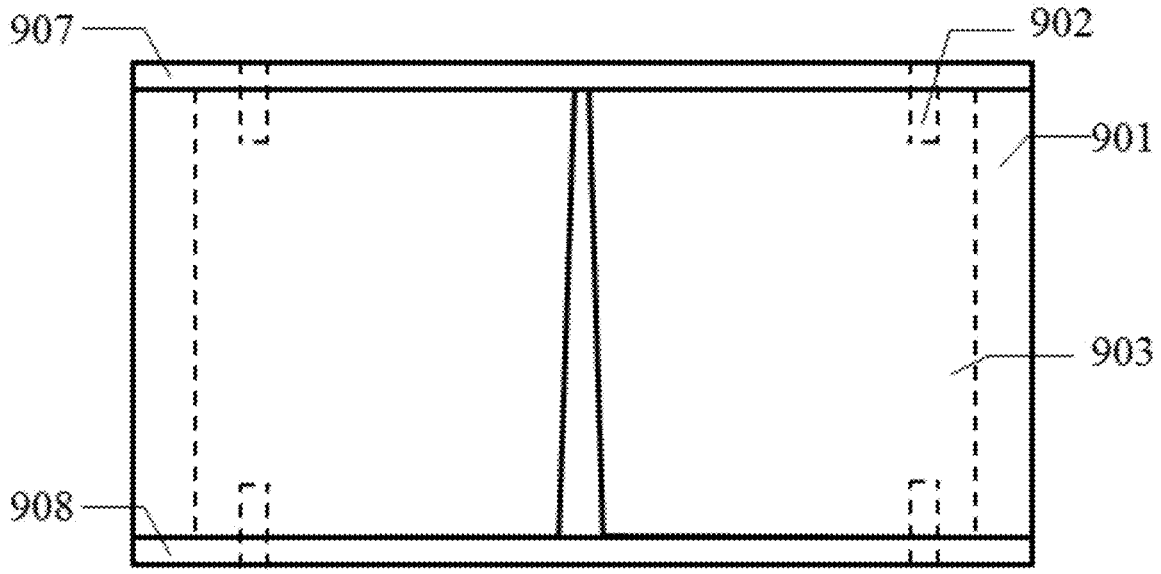
FIG. 5 is a side view illustrating the exemplary proppant transport and distribution system at the main fracture inlet or the main fracture outlet (that is, along a main fracture width) after the transparent cuboid fracture member is deformed according to some embodiments of the present disclosure.
Figure 6:
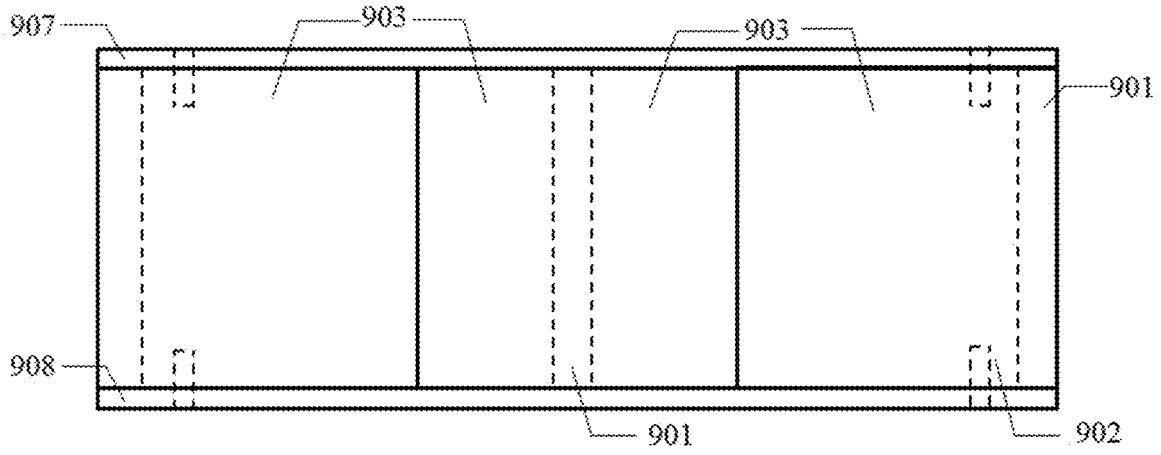
FIG. 6 is a side view illustrating the exemplary proppant transport and distribution system along a main fracture length according to some embodiments of the present disclosure.
Figure 7:
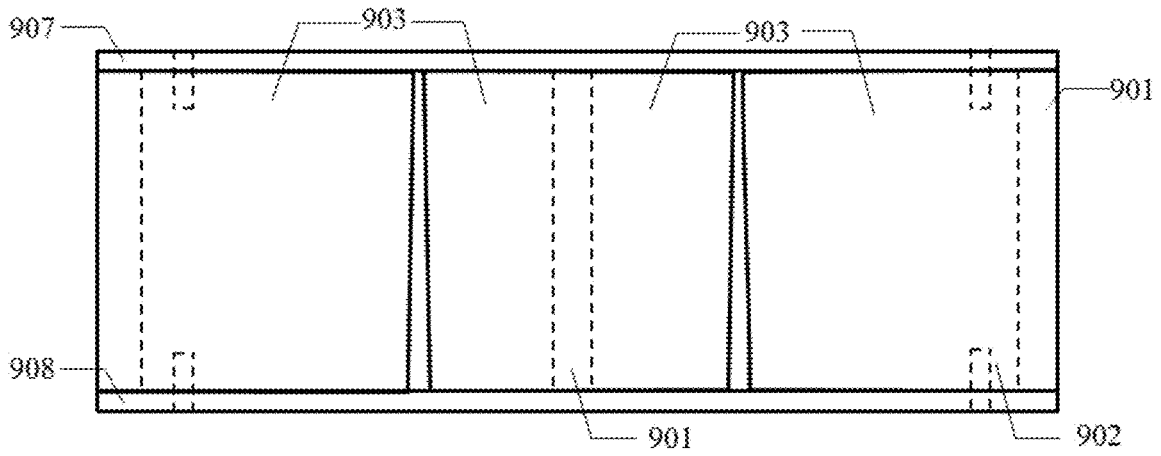
FIG. 7 is a side view illustrating the exemplary proppant transport and distribution system along the main fracture length after the transparent cuboid fracture member is deformed according to some embodiments of the present disclosure.
Figure 8:
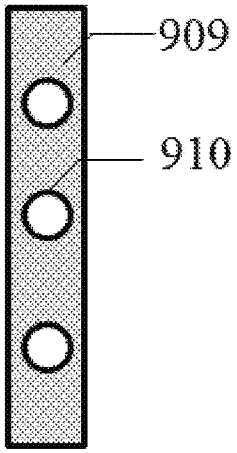
FIG. 8 is a schematic diagram illustrating an exemplary rubber with holes at a hydraulic fracture inlet, a hydraulic fracture outlet, or a natural fracture outlet according to some embodiments of the present disclosure.

FIG. 2 is a top view illustrating an initial state of an exemplary proppant transport and distribution system under a closure pressure according to some embodiments of the present disclosure. That is, FIG. 2 is a top view illustrating the proppant transport and distribution system 9 according to some embodiments of the present disclosure. The bolts 902 may be respectively disposed on the upper and lower surfaces of part of the transparent cuboid fracture member blocks, which are located at the main fracture inlet and the main fracture outlet, respectively. Each of the bolts 902 may be used to fix the cover plates (e.g., the upper cover plate, the lower cover plate) to the surfaces (e.g., the upper surface, the lower surface) of the transparent cuboid fracture member blocks, so as to prevent the sand-carrying fluid from eruption, and to ensure that the sand-carrying fluid can be pumped into the fractures. FIG. 4 is a side view illustrating the exemplary proppant transport and distribution system at a main fracture inlet or a main fracture outlet according to some embodiments of the present disclosure. FIG. 6 is a side view illustrating the exemplary proppant transport and distribution system along a main fracture length direction according to some embodiments of the present disclosure. In some embodiments, the transparent cuboid fracture member blocks at the main fracture inlet and the main fracture outlet may respectively include "L"-shaped hydraulic tanks 901, and the transparent cuboid fracture member blocks at the middle of a fracture length may respectively include "T"-shaped hydraulic tanks 901. When simulation experiments of different arrangements and intervals of natural fractures are performed, the transparent cuboid fracture member blocks including "T"-shaped hydraulic tanks 901 with different sizes can be used. Flowmeters and pressure gauges may be disposed at both ends of the proppant transport and distribution system 9, respectively. The sand-carrying fluid may enter the cyclone desander 13 along the manifold 11 after exiting from the main fracture outlet 905 of the proppant transport and distribution system 9. The waste liquid may flow into the waste liquid recycle container 14 after solid-liquid separation of the sand-carrying fluid. The waste solid may flow into the proppant recycle container 15 through the bottom outlet of the cyclone desander 13. After being treated reaching a standard level, the waste liquid may be re-pumped into the stirred tank 2 via the liquid transfer pump 7.

It should be noted that, in order to ensure that the experiment is visible, the transparent cuboid fracture member blocks, the cover plates, and the hydraulic oil in the hydraulic tank are all transparent. The pressure of the hydraulic oil may be precisely controlled by the hydraulic control device 12.

FIG. 4 is a side view illustrating the exemplary proppant transport and distribution system at a main fracture inlet or a main fracture outlet according to some embodiments of the present disclosure.

FIG. 6 is a side view illustrating the exemplary proppant transport and distribution system along a main fracture length according to some embodiments of the present disclosure.

As shown in FIGS. 4 and 6, the rubbers 909 may be used to adhere adjacent fracture surfaces to each other at each fracture inlet and each fracture outlet (e.g., the main fracture inlet, the main fracture outlet, the natural fracture outlets), respectively. There are three holes 910 on a surface of each of the rubbers 909.

An experimental method for simulating transport of sand-carrying fluid in one or more fracturing fractures may include the following operations.

(1) An amount of a proppant and a fracturing fluid may be prepared according to a predetermined sand ratio of an experiment, transported to a stirred tank 2 via a spiral proppant transport device 1, and stirred by a stirring motor 4, such that a sand-carrying fluid can be fully mixed;

(2) According to a length of a main fracture required for the experiment, the arrangement of natural fractures, and a space between the natural fractures, a plurality of transparent cuboid fracture member blocks 903 may be assembled to form a transparent cuboid fracture member, and an upper cover plate 907 and a lower cover plate 908 may be fixed to an upper surface and a lower surface of the transparent cuboid fracture member via bolts 902, respectively, so as to maintain a good seal between the cover plates and the transparent cuboid fracture member;

It should be noted that, when the fracture is deformed, a hydraulic piston device may be disposed externally to the hydraulic fluid since an internal pressure of the hydraulic fluid may be increased, the closing pressure may be kept constant by precise control of a computer, and the transparent cuboid fracture member is kept in an elastic range of the rubber incurring no mechanical damage.

Figure 9:
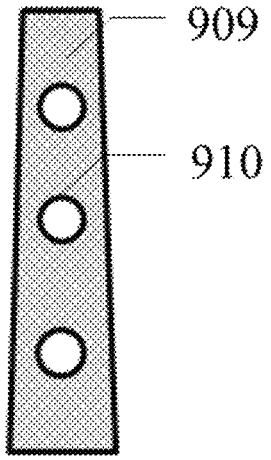
FIG. 9 is a schematic diagram illustrating exemplary deformation of the rubber at the hydraulic fracture inlet, the hydraulic fracture outlet, or the natural fracture outlet after the transparent cuboid fracture member is deformed according to some embodiments of the present disclosure.
Figure 10:
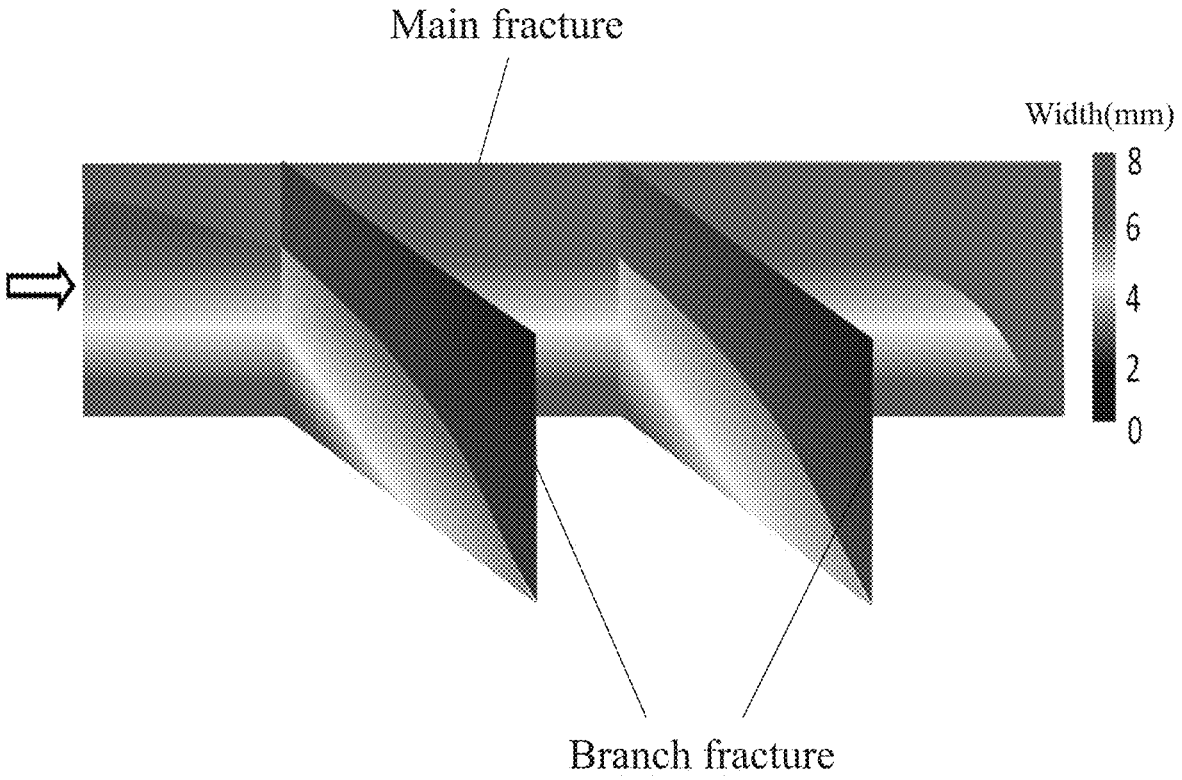
FIG. 10 illustrates an image of the distribution of fracture widths according to some embodiments of the present disclosure.

(3) After opening valves at fracture outlets and pumping the sand-carrying fluid, fracture surfaces of a main fracture and natural fractures undergo relative displacements, for example, opening and expanding, when an accumulated pressure of the fractures meets a required pressure for opening the fractures. The resulted relative displacements of the main fracture and the natural fractures may be seen from a top view shown in FIG. 3, from a side view of a main inlet of a hydraulic fracture (also referred to as a main fracture inlet) shown in FIG. 5, and from an external condition of a hydraulic fracture (also referred to as a main fracture) along a length direction of the hydraulic fracture shown in FIG. 7. In addition, the rubber may be deformed at each fracture inlet and each fracture outlet, as shown in FIG. 9. The electromagnetic flowmeter and pressure gauge at each fracture inlet and each fracture outlet may record a flow rate and a pressure at each moment when the rubber is being deformed, and transmit recorded data relating to the flow and the pressure to the computer 12 in real-time.

It should be noted that, when surfaces of the fractures adhered to rubbers undergo a relative displacement (e.g., at a level of mm), that is, the fractures are expanded, the rubbers has not yet reached a yield state and can still maintain a certain degree of sealing between the surfaces of the fractures.

(4) After the sand-carrying fluid enters a cyclone desander 13, a fracturing fluid may enter a waste liquid recycle container 14 and a proppant may enter a proppant recycle container 15 after solid-liquid separation, respectively;

It should be noted that, the fracturing fluid processed and up to a standard may be directly transferred to the stirred tank 2 through the liquid transfer pump 7, and the proppant can be recycled after being dried without changing a performance index of the proppant.

(5) When the experiment for simulating paving of a sand-carrying fluid is completed, the upper cover plate may be loosened, and fracture widths on the four outer sides of the transparent cuboid fracture member may be determined with a fracture width measuring device.

It should be noted that, in the experimental method according to the present disclosure, the accuracy of the fracture width measuring device meets the requirement of the experiment, the measured data by the fracture width measuring device includes echo amplitudes of sound waves, and values of the fracture widths at different positions may be obtained by processing and inverting the measured data via a computer.

The above description is not presented to limit the present disclosure in any form. Although the present disclosure has been disclosed through the above embodiments, but not intended to limit the protection scope of the present disclosure. For persons having ordinary skills in the art, multiple variations and modifications may be made under the teachings of the present disclosure. However, those variations and modifications do not depart from the scope of the present disclosure. According to the technical essence of the present disclosure, any simple modifications, equivalent changes, and modifications made to the content that does not depart from the technical scheme of the present disclosure are still within the scope of the present disclosure.

We claim:

1. An experimental apparatus for simulating transport of a sand-carrying fluid in one or more fracturing fractures, comprising a spiral proppant transport device (1), an stirred tank (2), a screw pump (6), a liquid transport pump (7), and a pressure gauge (8), a proppant transport and distribution system (9), a cyclone desander (13), a waste liquid recycle container (14), a proppant recycle container (15), and a fracturing fluid tank (17), wherein the spiral proppant transport device (1) is communicated with the stirred tank (2), the waste liquid recycle container (14) and the fracturing fluid tank (17) are both communicated with the stirred tank (2) through the liquid transport pump (7), a bottom of the stirred tank (2) is communicated with the proppant transport and distribution system (9) through the screw pump (6);

the proppant transport and distribution system (9) is communicated with the cyclone desander (13), an upper end of the cyclone desander (13) is communicated with the waste liquid recycle container (14), and a bottom end of the cyclone desander (13) is communicated with the proppant recycle container (15);

a flowmeter (10) is disposed between the cyclone desander (13) and the proppant transport and distribution system (9), and the pressure gauge (8) and the flowmeter (10) are disposed in parallel at two ends of the proppant transport and distribution system (9), respectively; and the proppant transport and distribution system (9) includes a plurality of transparent cuboid fracture member blocks (903), an upper cover plate (907), and a lower cover plate (908) connected to upper ends and lower ends of the plurality of transparent cuboid fracture member blocks (903), respectively, a hydraulic tank (901) filled with a transparent hydraulic fluid is disposed in each of the plurality of transparent cuboid fracture member blocks (903), a main fracture inlet (904) is disposed at a left end of at least one transparent cuboid fracture member block (903) at a leftmost end, a main fracture outlet (905) is disposed at a right end of at least one of the plurality of transparent cuboid fracture member blocks (903) at a rightmost end, and one or more natural fracture outlets (906) are disposed at an upper end of at least one of the plurality of transparent cuboid fracture member blocks (903).

2. The apparatus of claim 1, wherein the proppant transport and distribution system (9) includes a hydraulic control device (12).

3. The apparatus of claim 2, wherein a rubber (909) is disposed at each of the main fracture inlet (904), the main fracture outlet (905), and the one or more natural fracture outlets (906), there are three holes (910) on the rubber (909), a transparent cuboid fracture member comprising the plurality of transparent cuboid fracture member blocks (903), and when the transparent cuboid fracture member undergoes slight deformation, and the rubber has not yet reached a yield state, the transparent cuboid fracture member still maintains a sealing between surfaces of each of a main fracture and natural fractures, and the transparent cuboid fracture member is kept in an elastic range of rubber (909) incurring no mechanical damage.

4. The apparatus of claim 1, wherein the flowmeter (10) is an electromagnetic flowmeter.

5. The apparatus of claim 2, wherein a stirring shaft driven by a stirring motor (4) is disposed in the stirred tank (2), and a plurality of stirring blades (3) are disposed on the stirring shaft.

6. The apparatus of claim 5, wherein a weight tester is disposed below the stirred tank (2).

7. An experimental method for simulating transport of a sand-carrying fluid in one or more fracturing fractures, comprising:

preparing an amount of a proppant and a fracturing fluid based on a predetermined sand ratio, transporting the proppant and the fracturing fluid to a stirred tank (2) via a spiral proppant transport device (1), and being stirred by an stirring motor (4), such that the sand-carrying fluid can be fully mixed;

assembling a plurality of transparent cuboid fracture member blocks (903) to form a transparent cuboid fracture member according to a predetermined main fracture length, the arrangement of natural fractures, and a space between the natural fractures, wherein a hydraulic tank (901) filled with a transparent hydraulic fluid is placed in each of the plurality of transparent cuboid fracture member blocks (903), and an upper cover plate (907) and a lower cover plate (908) are fixed to an upper surface and a lower surface of the transparent cuboid fracture member via bolts (902), respectively;

simulating a closure pressure of each of the fractures by a hydraulic control device (12) to control the hydraulic tank (901);

turning on a drive control panel and starting the screw pump (6);

opening valves at a hydraulic fracture outlet and one or more natural fracture outlets, and a valve of a cyclone desander (13);

observing and recording, by a camera, a process of deformation of the transparent cuboid fracture member, wherein the deformation of the transparent cuboid fracture member is the hydraulic fracture and natural fractures opening and gradually expanding to a shape of a sandbank;

determining degrees of fracture openings at different locations of the hydraulic fracture and the natural fractures by a fracture width measuring device; and determining a rule of the sand-carrying fluid paved in the fractures based on processing data of the degrees of the fracture openings.

* * * * *